US006029273A

United States Patent [19]

McCrane

[11] Patent Number: 6,029,273

[45] **Date of Patent: *Feb. 29, 2000**

[54] PROTECTIVE DEVICE FOR USE IN ACTIVE SPORTS AND WORK ACTIVITIES

[76] Inventor: David P. McCrane, 1755 Industrial Way, #1, Napa, Calif. 94558

[ * ] Notice: Under 35 U.S.C. 154(b), the term of this patent shall be extended for 662 days.

[21] Appl. No.: 08/651,991

[22] Filed: May 21, 1996

[51] Int. Cl.[7] ..... A41D 13/00

[52] U.S. Cl. ..... 2/24; 2/22; 2/16; 2/908

[58] Field of Search ..... 2/24, 16, 455, 2/22, 908; 602/26, 20

[56] References Cited

U.S. PATENT DOCUMENTS

| | | | |
|---|---|---|---|
| 2,534,888 | 12/1950 | Vold | 2/24 |
| 2,561,872 | 7/1951 | Krinick | 2/23 |
| 3,473,527 | 10/1969 | Spiro | 602/26 |
| 4,561,123 | 12/1985 | Hull | 2/23 |
| 4,599,747 | 7/1986 | Robinson | 2/16 |
| 4,700,698 | 10/1987 | Kleylein | 602/26 |
| 5,105,473 | 4/1992 | Valtakari | 2/2 |
| 5,373,584 | 12/1994 | Parcells, III | 2/2 |
| 5,390,368 | 2/1995 | Chang | 2/908 |
| 5,446,926 | 9/1995 | Bourque et al. | 2/455 |
| 5,472,413 | 12/1995 | Detty | 602/26 |
| 5,477,559 | 12/1995 | Clement | 2/22 |

OTHER PUBLICATIONS

Photograph of prior art Lazzy Legs knee pad (prior to 1995).
Photograph of prior art Alta Industries knee pad (prior to 1988).

*Primary Examiner*—Bibhu Mohanty
*Attorney, Agent, or Firm*—Flehr Hohbach Test Albritton & Herbert LLP; Richard E. Backus

[57] ABSTRACT

A protective device which can be employed for preventing injuries to a person's limbs in active sports and work activities. The device is comprised of a cushioning pad, a replaceable wear cap and a fastening structure which releasably fastens between the inner surface of the wear cap and the outer surface of the cushioning pad. The cushioning pad is adapted to fit about a limb of the user. The fastening structure includes a first layer which is comprised of a material having a plurality of loops, and a second layer comprised of a material having a plurality of hooks. The hooks of the second layer are unidirectional and when the two layers are brought into facing contact the hooks and loops interengage in a manner so that the wear cap has a greater resistance to force components vectored opposite the common direction in which the hooks face. A method of releasing the wear cap from the cushioning pad includes moving the edge of a blade-like tool through the interface between the two layers along the common direction so that the two layers disengage and separate.

18 Claims, 4 Drawing Sheets

PROTECTIVE DEVICE FOR USE IN ACTIVE SPORTS AND WORK ACTIVITIES

BACKGROUND OF THE INVENTION

1. Field of the Invention

This invention relates in general to protective devices for use in active sports and work activities such as in-line skating, skateboarding, roller skating, tile-laying, gardening and the like. More particularly, the invention relates to protection of the limbs of people engaged in those activities.

2. Description of the Related Art

Protection devices such as knee and elbow pads are commonly used in sports such as in-line skating, skateboarding and roller skating to protect against bodily injury during falls on pavement or other hard surfaces. The conventional knee and elbow pad designs comprise a padded layer which is strapped about the user's knee or elbow together with a concaval wear cap which is secured to the front of the padded layer. The wear cap is typically formed of a hard plastic material, such as high molecular weight polyethylene, having a smooth surface which permits the wear cap to slide over the pavement. This dissipates some of the energy from a fall.

The older designs for knee/elbow pads employed rivets or grommets to secure the wear caps to the front of the padded layers. One limitation of those designs is that the users could not remove the wear caps; thus when the caps wore out it was necessary to throw away and replace the knee or elbow pads, which were expensive. More recently, manufacturers have provided removable wear caps so that when the caps wear down they can be replaced with new ones without having to throw away the expensive pads. One such prior design employs complementary hook and loop fasteners (Velcro®, for example) for releasably attaching the wear caps to the pads.

The Velcro® fastening system was invented by a Swiss engineer, George de Mestral, who conceived of the idea after pulling cockleburs from his trousers and his dog's hair one day in the early 1940's. Examination of the burs under a microscope revealed arrays of tiny hooks that would attach to anything looplike. The trademark name Velcro is an acronym for the French words "velours" and "crochet," which mean "velvet" and "hook," respectively. The present-day Velcro® fastening system provides pads carrying miniature rows of hooks and loops which are from 15 thousandths to 100 thousands of an inch high. A two-inch square piece may contain as many as many as 3,000 hooks and loops, although only about one-third may be engaged when the pads are together. Such a two-inch square piece may resist a force of up to 45 pounds per square inch of shear force applied parallel to the base of the hooks. The hooks and loops can be detached with less force when pulled at an oblique angle because the diagonal tugging disconnects only a single row apart a time rather than the entire complement of hooks and loops.

Conventional hook and loop fasteners in which the pointed hook ends are randomly oriented resist shear forces equally in all directions parallel to the base. When a tension force is applied at a right angle to the base, the fasteners have an unfastening resistance of up to 20 pounds per square inch.

There are a number of limitations and disadvantages in the use of conventional hook and loop fasteners for attaching wear caps in protection devices such as knee/elbow pads. One is that adhesives do not work well for attaching the hook and loop fabric sides to either the padding or the wear cap. Another problem is that conventional hook and loop fasteners are not strong enough to securely hold the wear caps in place such that they can be dislodged from aggressive forces encountered during falls onto hard pavement. A further problem is that the aggressive heavy duty hooks tend to wear out over a short period of time such that if the user attempts to replace the wear cap with one having a new strip of loop fabric it would not work properly because the worn hooks will not securely engage the fabric. In addition, the heavy duty hooks tend to shred and eventually wear out the loop fabric because of the aggressive pulling forces that are generated after removing the caps only a few times for adjustment or replacement. This leads to further deterioration of the fastening system, thus making it necessary to replace the entire expensive pad, if the loop fabric were to be attached to the pad.

A further problem with conventional protective devices which use hook and loop strips to attach the wear caps is that the strips tend to lock up before the user can get the cap all the way on to the padded layer. To avoid this problem manufacturers have made the caps flatter and with less curvature, but this is undesirable in that the wear pads then do not properly conform about the user's knee or elbow.

The need has therefore been recognized for a protective device which obviates the foregoing and other limitations and disadvantages of the prior art knee/elbow pads. Despite the various knee/elbow pads in the prior art, there has heretofore not been provided a suitable and attractive solution to these problems.

OBJECTS AND SUMMARY OF THE INVENTION

It is a general object of the present invention to provide a new and improved protective device for protecting the limbs of people engaged in active sports or work activities such as in-line skating, skateboarding, roller skating, tile-laying, gardening and the like.

Another object is to provide a protective device of the type described which releasably secures a wear cap to a cushioning pad in a manner which securely holds the wear cap in place against the aggressive forces encountered during falls onto hard pavements while also permitting the user to selectively release the wear cap for replacement.

Another object is to provide a protective device of the type described in which a wear cap is releasably fastened to the cushioning pad by a plurality of complementary hook and loop fastener strips which are arrayed so that, in combination, they strongly resist pulling forces in many different directions.

Another object is to provide a method of releasing the interengagement of the hook and loop fastening strips which hold a replaceable wear cap to the cushioning pad of a protective device of the type described.

The invention in summary comprises a cushioning pad which is adapted to fit about the limb of a participant in an active sport or work activity. A replaceable wear cap is provided together with a fastening structure which is releasably carried between the inner surface of the wear cap and the outer surface of the cushioning pad. The fastening structure comprises a cooperating pair of first and second layers. The first layer is comprised of a material having a plurality of loops. The second layer is formed into segments each of which is comprised of a material having a plurality of hooks. The hooks of each segment have distal ends which point substantially unidirectionally so that when the hooks interengage with the loops the segment has a maximum resistance to force components vectored opposite the direction that the hook ends point. The hooks are released by the method of moving the blade-like portion of a thin flat tool in the direction the hook ends point along the length of the interface between the hooks and loops.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1:
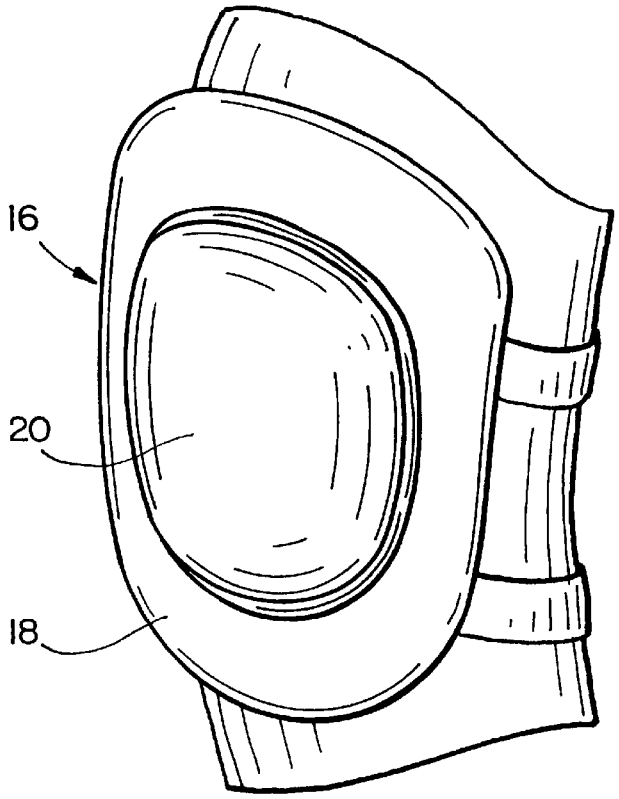
FIG. 1 is a perspective view illustrating the protective device in accordance with one embodiment shown attached to a user's knee by leg straps.
Figure 2:
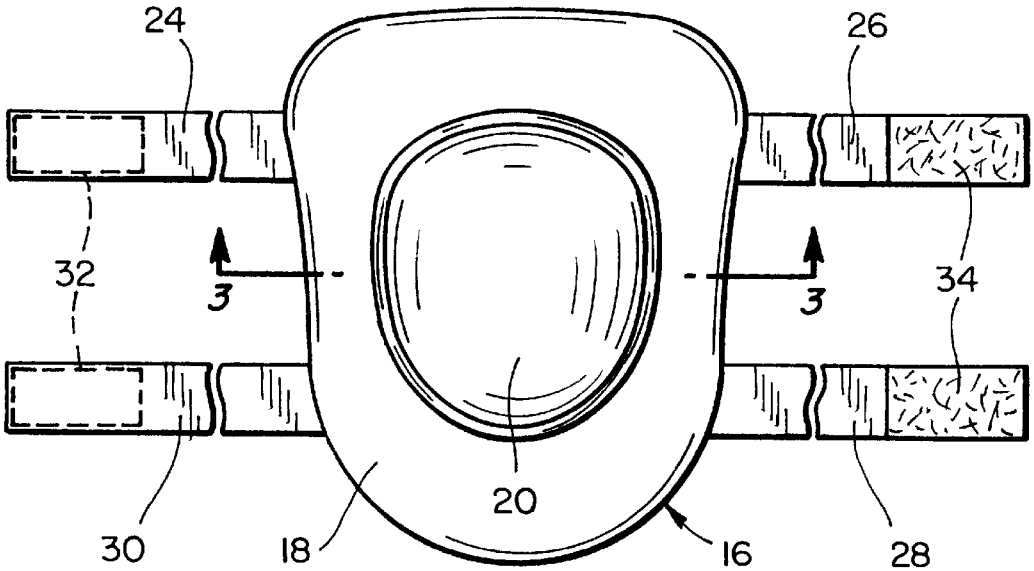
FIG. 2 is a front elevation view of the protective device of FIG. 1 showing the leg straps uncoupled and extending outwardly.
Figure 3:
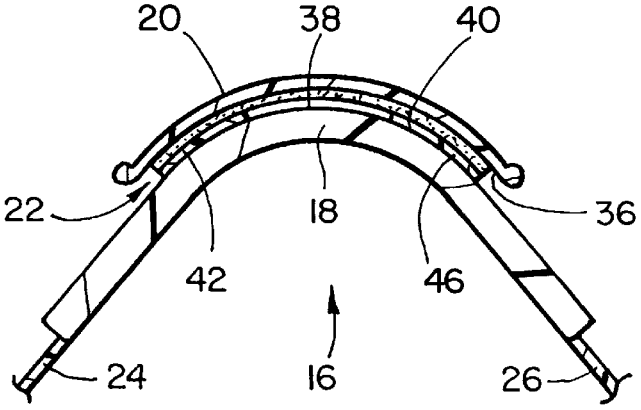
FIG. 3 is a cross sectional view, to an enlarged scale, taken along the line 3—3 of FIG. 2.

In the drawings FIGS. 1–3 illustrate a protective device 16 in accordance with one preferred embodiment of the invention. Protective device 16 is comprised of a cushioning pad 18, replaceable wear cap 20 and fastening structure 22 (FIGS. 3 and 5) which is releasably carried between the wear cap and cushioning pad. Protective device 16 as shown in the figures is adapted to be strapped about the knee of a participant in sports such as inline skating, skateboarding, roller skating and other active sports where falls onto hard pavement or other surfaces can be expected. Identical protective devices would typically be provided for each knee of the user. The device can be modified in size and shape suitable for use in protecting the participant's elbow, shin or hand. The protective device can also be adapted for use by people engaged in work activities such as tile-laying or gardening. When so used the device protects the person's limbs from injury. As used herein, "limb" and "limbs" means knees, elbows, shins, or hands, depending upon the particular configuration of the device.

Cushioning pad 18 is formed of a suitable yieldable and force-absorbing material such as a foamed polymer, a felt material, or a combination of foamed, felt or other similar elastic materials. Preferably pad 18 has a generally rectangular shape with its edges rounded in the manner shown in FIG. 2. The pad is releasably attached to the user's knee by means of elongated straps 24–30 which are secured to the edges of the pad by means such as sewing. Preferably the pad is formed with a shape that is concave toward the knee. At the opposite ends of the straps, strips 32, 34 of complementary hook and loop fasteners (Velcro®, for example) are secured for releasably attaching the strap ends together in loops around the knee.

Replaceable wear cap 20 is formed of a suitable material which is resistant to abrasion and which also has a smooth outer surface to enable the cap to slide along a hard pavement surface. This sliding action helps dissipate a part of the energy resulting from falls. A high molecular weight polyethylene or other synthetic plastics such as ABS or polypropylene are suitable for this purpose. For some industrial applications, the wear cap should be a softer semi-rigid material so as to prevent skidding, sliding and swiveling for work activities such as tile laying, aircraft baggage handling and the like. The wear cap can be either thermo-formed or injection molded into an inwardly concave cup-shaped curvature so as to generally conform with the user's knee.

Figure 7:
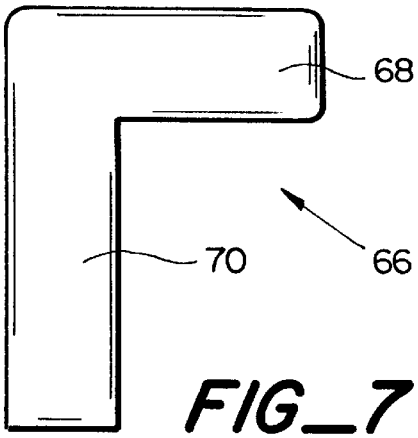
FIG. 7 is a plan view of a tool used in the method of unfastening the cooperating pairs of hook and loop fastener layers of the device of FIG. 1.

Fastening structure 22 is comprised of complementary layers of hook and loop fasteners (Velcro®, for example). The layers are carried between inner surface 36 of the wear cap and outer surface 38 of the cushioning pad. In this embodiment, as best illustrated in FIG. 3, a first layer 40 of the loop material is secured by suitable means, such as adhesive, to the inner surface of the wear cap. Typically the loop material comprises yarn loops 41 (FIG. 5) formed in a pile on a fabric backing strip. A second layer, comprised of four segments 42–48 (FIG. 4), of the complementary hook material is secured by means such as adhesive to the outer surface of the cushioning pad. In this embodiment the four hook material segments are arrayed in the "+" configuration shown in FIG. 4 with spaced-apart pairs of the segments lying along orthogonal axes. The spaced-apart relationship facilitates the insertion of a blade-like tool (FIG. 7) between the segments to disengage the hooks and loops.

An important feature of the invention is that the hooks which form segments 42–48 are substantially unidirectional. As best shown in FIG. 5 for the typical segment 46, the hooks 50 are each formed with standing portions 52 which terminate in pointed distal ends 54 that releasably engage the loops 41 on the fabric layer when the two layers are brought into facing contact. As used herein, "substantially unidirectional" means that the distal ends of all or substantially all of the hooks point in a common direction. In the illustrated embodiment the hook distal ends point to the right-hand side of FIG. 4 in the direction indicated by arrow 56. Such unidirectional hook orientation can be achieved by a suitable injection molding process. Strips of unidirectional hooks are available commercially from Velcro USA, Manchester, N.H.

The unidirectional hook fasteners used in the invention are characterized in having a greater resistance to force components which are vectored opposite the common direction at which the hook distal ends point. Thus the maximum pulling resistance is in the direction indicated by the arrow 58 of FIG. 5. That is, the fastening structure will have a maximum resistance to unfastening when subjected to a shear force which is vectored in the direction 58 parallel to segment 46. With the unidirectional hooks this maximum resistance to unfastening is much greater than the 45 pounds per square inch that would be obtainable in a conventional non-unidirectional hook and loop fastening structure. The greater number of hooks that are engaged with loops then the greater will be the unfastening resistance. The number of engaged hooks in turn depends on the degree to which hook segments 42–48 are pressed against loop layer 40. Greater compression forces applied between the hook and loop material, such as from repeated impacts against the wear cap during falls, will tend to create very strong locking between the hooks and loops.

Figure 4:
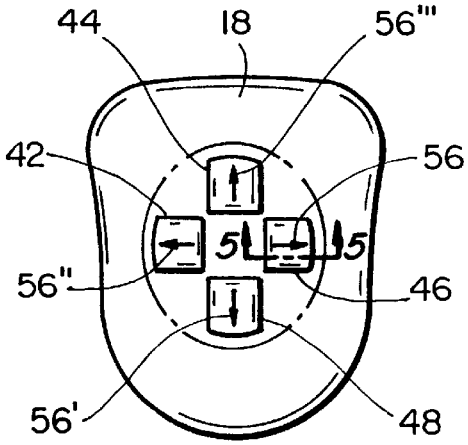
FIG. 4 is a plan view, to a reduced scale, showing orientation of four hook segments on the outer surface of the cushioning pad in the protective device of FIG. 1.
Figure 5:
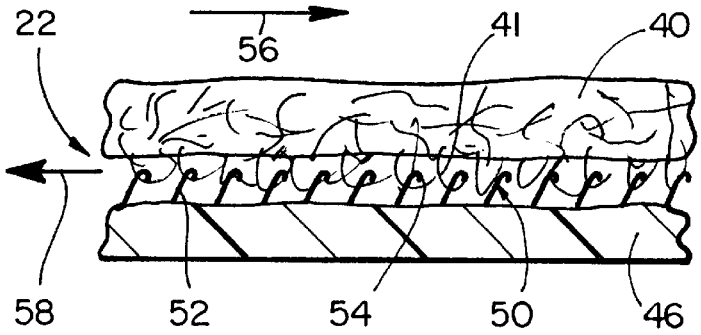
FIG. 5 is a fragmentary enlarged view taken along the line 5—5 of FIG. 4 showing interengaged portions of hook and loop layers.
Figure 6:
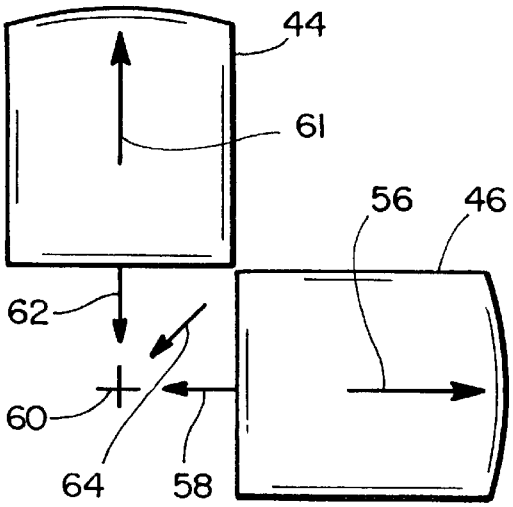
FIG. 6 is a schematic diagram showing the typical resultant force vectors acting on two cooperating pairs of hook and loop fastener segments in the device of FIG. 1.

The four hook material segments are attached in the "+" orientation shown in FIG. 4 so that the direction of maximum pulling resistance for each segment points radially outwardly. This is illustrated schematically in FIG. 6 for the two hook segments 44 and 46 which are circumferentially spaced apart at right angles about the center 60 of the cluster of four segments.

The distal ends of the hooks in segment 44 point radially outwardly in the direction indicated by arrow 61, which is 90° from direction 56 of the hook distal ends in segment 46. Arrow 62 is the direction of maximum resistance to unfastening of segment 44. The combined resistance to shear forces which are simultaneously applied to these two segments is shown by arrow 64. This represents the maximum resistance to a resultant shear force which is vectored radially inwardly toward center 60 of the four strips. With this configuration the resistance to pulling forces of the four strips is combined in a manner so that wear cap 20 is firmly held in place and cannot be dislodged when struck by impact forces coming from any point at 360° about the center of the wear cap. For example, assuming that the wear cap is struck with a force directed inwardly from the right side of FIG. 4, which is at the 90° position, the force is strongly resisted by the interengagement of the opposite hook material segment 42 and overlying loops. And when the impact force is directed upwardly from the 180° position, it is strongly resisted by interengagement of uppermost hook material segment 44 with the overlying loops. Impact forces coming from a 120° direction, for example, are opposed by the combined resistance of segments 42 and 44.

The invention contemplates that the fastening structure could also be arranged with segments of hook material secured by means such as adhesive to the inner face 36 of the wear cap while the layer of fabric material could be secured to the outer surface 38 of the cushioning pad by suitable means such as sewing or adhesive. In addition, the unidirectional hooks could be integrally molded with the inner face of the wear cap.

While in the illustrated embodiment FIG. 4 shows hook material segments which are generally square shaped, the invention contemplates that the segments could be other shapes, such as rectangular, triangular or oblong in accordance with the specifications and requirements of a particular application.

Wear cap 20 can be easily secured to cushioning pad 18 by centering it over the pad and then pressing the cap down onto the hook segments 42–48. Due to the curvature of the cap and pad (FIG. 3), the hook segments and overlying portions of the loop material when making contact undergo relative movement in the directions shown by the arrows 56, 56', 56", 56'''in FIG. 4. In these directions the loops easily slide over the hooks without interengagement until the cap is fully seated against the cushioning pad. This avoids the problem of premature locking of the hooks and loops that is common with the prior art replaceable knee/elbow pads.

It is a characteristic of the unidirectional hooks that the more the wear cap is worked with, such as by applying manual force or from impact forces during falls, then the tighter the interlock will be between the hooks and loops. In this manner the interlocking forces can become so tight that a person would not be strong enough to pull the wear cap off.

Figure 8:
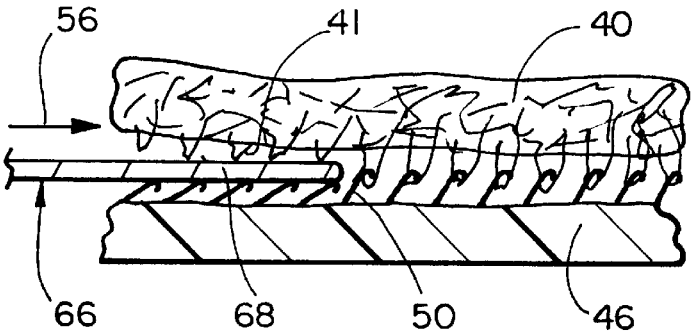
FIG. 8 is a view similar to FIG. 5 showing the method of unfastening the hook and loop layers using the tool of FIG. 7.

The invention provides a method for easily releasing the wear cap without the need to use a great deal of force. The method employs the use of the L-shaped tool 66 illustrated in FIG. 7. Preferably tool 66 is formed of a suitable durable plastic material and is shaped with a pair of thin, flat blade-like arms 68, 70 which diverge at a 90° angle. The blade edges preferably are rounded as shown in FIG. 8. Holding one arm 70 of the tool in the user's hand, the other arm 68 is first positioned as in FIG. 8 so that one of its edges is on the side of hook segment 46 which is opposite the direction (arrow 56) the hook distal ends face. The tool is then moved so that its edge moves in the hook end direction. This causes arm 68 to separate the hooks and loops so that the fastening structure is disengaged in the manner shown in FIG. 8. The tool is pulled completely through the interface, thus completely disengaging hook segment 46 from first layer 40. The method is repeated by similarly using the tool to separate the three remaining hook segments from the first layer. This permits the wear cap to then be removed and adjusted or replaced with a new one.

The unfastening method of the invention disengages the hooks and loops in a manner which does not tend to cause them to break down or deteriorate. In contrast, the more often hook and loop fasteners are disengaged in the conventional manner by pulling the opposing layers apart then the more the hooks and loops deteriorate. Using the method of the present invention, the duty cycle is increased to prolong the useful life of the fastening system and therefore of the protective device.

Figure 9:
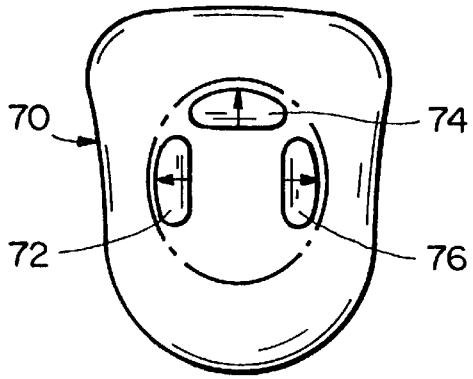
FIG. 9 is a view similar to FIG. 4 showing the orientation of three hook segments onto the outer surface of a cushioning pad in a protective device according to another embodiment of the invention.

FIG. 9 illustrates an embodiment providing a modified arrangement for releasably fastening a wear cap, not shown, to the outer surface of a cushioning pad 70. In this embodiment three oval-shaped hook material segments 72–76 are secured to the outer surface of the cushioning pad in an orientation in which two segments 72 and 76 are spaced apart along a horizontal axis and one segment 74 is circumferentially spaced 90° between the other segments. The unidirectional hooks of the segments are oriented so that their hook distal ends point in the directions indicated by the arrows shown for the respective segments. The vectors of maximum pulling resistance for the segments are opposite these arrows.

Figure 10:
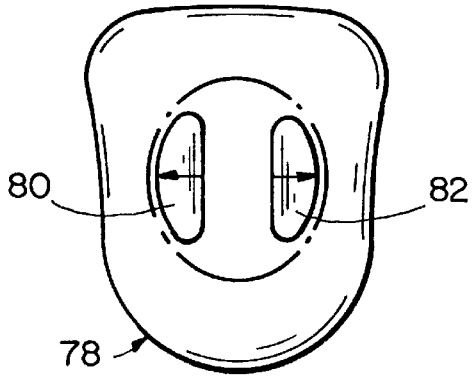
FIG. 10 is a view similar to FIG. 4 showing the orientation of two hook segments onto the outer surface of a cushioning pad in a protective device according to another embodiment of the invention.

FIG. 10 illustrates another embodiment providing a modified structure for releasably fastening a wear cap, not shown, to a cushioning pad 78. In this embodiment the fastening structure is comprised of two vertically elongate oval hook material segments 80 and 82 which are horizontally spaced apart. The unidirectional hooks of the segments are arranged so that their hook distal ends point radially outwardly as shown by the arrows for the respective pads, and the vectors of the maximum pulling resistance for the segments are in opposite directions.

Figure 11:
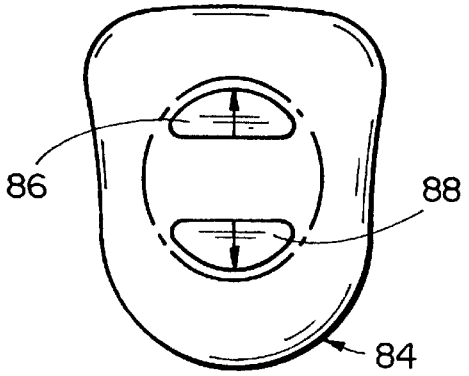
FIG. 11 is a view similar to FIG. 4 showing the orientation of two hook segments onto the outer surface of a cushioning pad in a protective device according to another embodiment of the invention.

FIG. 11 illustrates another embodiment providing a modified structure for releasably fastening a wear cap, not shown, to a cushioning pad 84. In this embodiment the fastening structure comprises a pair of horizontally elongated oval hook material segments 86 and 88 which are vertically spaced apart. The unidirectional hooks of the segments are arranged so that their hook distal ends point radially outwardly as shown by the arrows for the respective pads, and the vectors of the maximum pulling resistance for the segments are in opposite directions.

Figure 12:
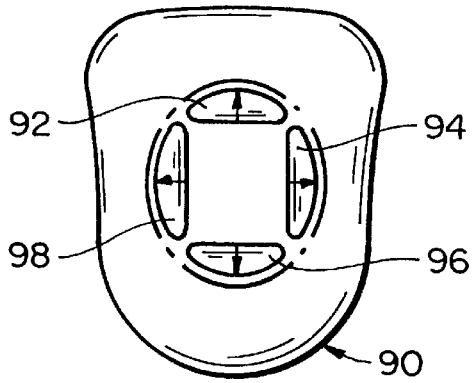
FIG. 12 is a view similar to FIG. 4 showing the orientation of four hook segments onto the outer surface of a cushioning pad in a protective device according to another embodiment of the invention.

FIG. 12 illustrates another embodiment providing a modified structure for releasably fastening a wear cap, not shown, to a cushioning pad 90. The fastening structure comprises four oval-shaped hook material segments 92–98 which are oriented in a "+" pattern in the manner of the embodiment of FIG. 4. The unidirectional hooks of the segments are arranged so that their hook distal ends point radially outwardly as shown by the arrows for the respective pads, and the vectors of the maximum pulling resistance for the segments are in opposite directions.

Figure 13:
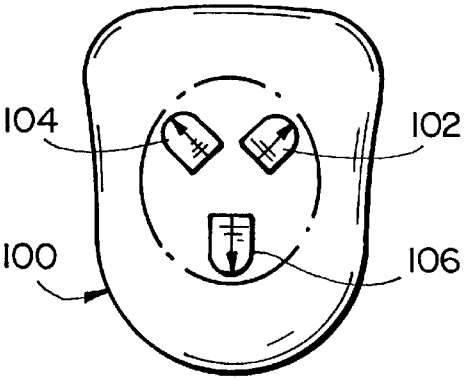
FIG. 13 is a view similar to FIG. 4 showing the orientation of three hook segments onto the outer surface of a cushioning pad in a protective device according to another embodiment of the invention.

FIG. 13 illustrates an embodiment providing a modified structure for releasably fastening a wear cap, not shown, to a cushioning pad 100. The fastening structure comprises three rectangular hook material segments 102–106 which are secured to the outer surface of the cushioning pad in a "Y" pattern. The unidirectional hooks of the segments are arranged so that their hook distal ends point radially outwardly in the directions indicated by the arrows for the respective pads, and the vectors of the maximum pulling resistance for the segments are in opposite directions.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A protective device for use in active sports and work activities for protecting the limb of a user from injury, the device comprising the combination of a cushioning pad having an inner surface and an outer surface, the inner surface being adapted for fitting about portions of the user's limb for attachment thereto; a replaceable wear cap having an inner face, said wear cap being formed of a material having a strength which is effective to substantially resist forces from contact with a surface or object; a fastening structure which is releasably carried between the inner surface of the wear cap and the outer surface of the cushioning pad, the fastening structure comprising a first layer formed of a material having a plurality of loops and a second layer formed of a material having a plurality of hooks, said hooks being formed with standing portions which terminate in distal ends and with the distal ends of at least a portion of the hooks being adapted for releasable interengagement with portions of the loops when the layers are brought into facing contact, the second layer comprising a first segment and a second segment, said hooks in the first segment being substantially unidirectional with their distal ends pointing in a first direction and said hooks in the second segment being substantially unidirectional with their distal ends pointing in a second direction which diverges at a predetermined angle relative to the first direction.

2. A protective device as in claim 1 in which said cushioning pad has an outer periphery and a center within the periphery, and said first and second segments are circumferentially space-apart about the center.

3. A protective device as in claim 1 in which said cushioning pad has an outer periphery and a center within the periphery, and said first and second directions of the hook distal ends point radially outwardly from the center toward the periphery.

4. A protective device as in claim 1 in which the first layer is carried by the inner surface of the wear cap and the second layer is carried by the outer surface of the cushioning pad.

5. A protective device as in claim 1 in which said cushioning pad has an outer periphery and a center within the periphery, and the first and second segments are radially spaced-apart and oriented on opposite sides of the center.

6. A protective device as in claim 1 in which said angle is substantially a right angle.

7. A protective device as in claim 1 in which said angle is an obtuse angle.

8. A protective device as in claim 1 in which said angle is substantially 180°.

9. A protective device as in claim 1 in which said second layer further comprises a third segment, said hooks in the third segment being substantially unidirectional with their distal ends pointing in a third direction which diverges at a predetermined angle relative to the first direction.

10. A protective device as in claim 9 in which said cushioning pad has an outer periphery and a center within the periphery, and said first, second and third segments are circumferentially space-apart about the center.

11. A protective device as in claim 10 in which the first, second and third segments are circumferentially spaced-apart about the center at 120° angles.

12. A protective device as in claim 9 in which said second layer further comprises a fourth segment, said hooks in the fourth segment being substantially unidirectional with their distal ends pointing in a fourth direction which diverges at a predetermined angle relative to the first direction.

13. A protective device as in claim 12 in which said cushioning pad has an outer periphery and a center within the periphery, and said first, second, third and fourth segments are circumferentially space-apart about the center.

14. A protective device as in claim 13 in which the first, second, third and fourth segments are circumferentially spaced-apart about the center at 90° angles.

15. A protective device as in claim 1 which includes strap means for securing the cushioning pad about the user's limb.

16. A protective device as in claim 1 in which the first and second segments are oriented in spaced-apart relationship.

17. A method of using a tool having a blade-like portion for unfastening a replaceable wear cap from a cushioning pad in a protective device of the type used for active sports or work activities for protecting a user's limb from injury and in which a fastening structure carried between the cushioning pad and wear cap is comprised of a first layer formed of a material having a plurality of loops and a second layer formed of a material having a plurality of hooks, the hooks being formed with standing portions which terminate in distal ends and with the distal ends of at least a portion of the hooks on the second layer being adapted for releasable interengagement with loops on the first layer when the layers are brought into facing contact, the second layer comprising a first segment and a second segment, said hooks in the first segment being substantially unidirectional with their distal ends pointing in a first direction, said hooks in the second segment being substantially unidirectional with their distal ends pointing in a second direction which diverges at a predetermined angle relative to the second direction, the method comprising the steps of moving the blade-like portion of the tool in a plane between the first layer and the first segment of the second layer substantially in the direction the hook distal ends of the first segment point, and causing the blade-like portion to separate the hooks and loops and disengage the first layer and first segment.

18. A method as in claim 16 in which the hooks in the second segment have their distal ends pointing substantially unidirectional, the method further including the steps of moving the blade-like portion of the tool in a plane between the first layer and the second segment of the second layer substantially in the direction the hook distal ends of the second segment point, and causing the blade-like portion to separate the hooks and loops and disengage the first layer and second segment.

* * * * *

UNITED STATES PATENT AND TRADEMARK OFFICE

CERTIFICATE OF CORRECTION

PATENT NO. : 6,029,273
DATED : February 29, 2000
INVENTOR(S) : McCrane

It is certified that error appears in the above-identified patent and that said Letters Patent is hereby corrected as shown below:

Title page,
[*] delete "662" and insert -- 7 --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*